US006675403B2

(12) United States Patent
Akhtar et al.

(10) Patent No.: US 6,675,403 B2
(45) Date of Patent: Jan. 13, 2004

(54) PORTABLE SAUNA

(75) Inventors: Aijaz Akhtar, Oxford (GB); Man Kei Chang, Kent (GB)

(73) Assignee: Aroma Health International Limited, Oxford (GB)

( * ) Notice: Subject to any disclaimer, the term of this patent is extended or adjusted under 35 U.S.C. 154(b) by 55 days.

(21) Appl. No.: 09/919,907

(22) Filed: Aug. 2, 2001

(65) Prior Publication Data

US 2003/0024040 A1 Feb. 6, 2003

(30) Foreign Application Priority Data

Aug. 2, 2000 (GB) ..... 0018832

(51) Int. Cl.[7] ..... A61H 33/06

(52) U.S. Cl. ..... 4/526; 4/524; 4/528; 4/531; 4/535; 4/598; 4/599

(58) Field of Search ..... 4/524, 526–535, 4/598–600; 135/91, 92, 139, 143, 144, 148

(56) References Cited

U.S. PATENT DOCUMENTS 507,078 A * 10/1893 Parker ..... 4/524
2,539,710 A * 1/1951 Sziklay ..... 4/527
4,612,741 A 9/1986 Jacobson ..... 52/79
5,133,378 A * 7/1992 Tanasychuk ..... 135/148
5,511,254 A * 4/1996 O'Brien ..... 135/157
5,622,198 A * 4/1997 Elsinger ..... 135/148
6,276,001 B1 * 8/2001 Chen ..... 4/527

FOREIGN PATENT DOCUMENTS

GB 2195530 A * 4/1988

* cited by examiner

*Primary Examiner*—Tuan N. Nguyen
(74) *Attorney, Agent, or Firm*—Young & Thompson

(57) ABSTRACT

A sauna apparatus (1) is configurable in an assembled configuration and in a disassembled configuration to allow storage and/or transport. The apparatus is formed from at least a first frame portion (2) and a second frame portion (3) connectable to the first frame portion. Each of the first and second frame portions (2, 3) comprises a respective part (2*a*, 3*a*) of a base of the sauna, a respective part of the roof (2*c*, 3*c*) of the sauna, and at least one support member (2*b*, 3*b*) connecting the respective part of the base of the sauna to the respective part of the roof of the sauna. The support members (2*b*) are preferably provided with hinges (9, 10; 9') to allow the frame portions to be folded so reduce the space required for storage. The base of the sauna is preferably provided with a recess 11 for receiving a footspa 12 or other foot relaxation apparatus.

16 Claims, 6 Drawing Sheets

PORTABLE SAUNA

FIELD OF THE INVENTION

The present invention relates to a portable sauna. The term "sauna" as used herein is not limited at an apparatus that provides a dry heat environment, but is intended also to encompass an apparatus that can provide a steam or vapour environment for a person.

BACKGROUND TO THE INVENTION

A portable sauna is a sauna enclosure that can be disassembled for transport or storage. One type of portable sauna is disclosed in UK patent application GB-A-2 195 530. This discloses a prefabricated sauna made from a front box portion and a rear box portion. The box portions are provided with releasable coupling-clamps to enable the two box portions to be connected to one another to form the sauna. When it is desired to transport or store the sauna the first and second box portions are disconnected from one another to facilitate the transport or storage of the sauna.

This prior art sauna is, however, not satisfactory. Although the sauna can be split into two box portions, each box portion is still bulky and heavy, and is difficult to transport and store.

ACKNOWLEDGEMENT OF THE PRIOR ART

GB-A-2 195 530 discloses a further portable sauna, in which an enclosure is formed by joining four side panels, a roof and a base to one another. This prior art portable sauna is, however, difficult to assemble since a stable structure is not formed until all the side panels, the base and the roof have been connected to one another.

SUMMARY OF THE INVENTION

The present invention provides a sauna apparatus configurable in an assembled configuration and in a disassembled configuration, the apparatus comprising: a first frame portion; and a second frame portion connectable to the first frame portion; wherein each of the first and second frame portions comprises a respective part of a base of the sauna, a respective part of the roof of the sauna, and at least one support member connecting the respective part of the base of the sauna to the respective part of the roof of the sauna.

The sauna of the invention is assembled by connecting the first frame portion to the second frame portion. The roof portion of the first frame portion and the roof portion of the second portion together constitute the roof of the sauna, and the base portion of the first frame portion and the base portion of the second portion together constitute the base of the sauna. The roof of the sauna is suspended above the base by the support members. This provides a stable frame, and side panels can then be attached one by one to the frame portions, to complete the enclosure of the sauna. Assembly and disassembly of a sauna of the invention are therefore straightforward to carry out.

Because the side panels can be detached from the frame portions, as well as the two frame portions being separable from one another, a sauna of the present invention is easier to transport than the sauna of GB-A-2 195 530 formed of two box portions.

In a preferred embodiment the or each support member of the first frame portion is a hinged support member. Preferably, the or each support member of the second frame portion is a hinged support member. Thus, when the side panels have been removed from the frame portions, the support members can be folded to reduce the space occupied by the first frame portion and/or the second frame portions. This reduces the space occupied by the sauna when it is disassembled, and so facilitates transport and storage of the sauna.

In a particularly preferred embodiment each support member is provided with a first hinge and with a second hinge. The first hinge may be provided towards the end of the support member adjacent the respective base portion, and the second hinge may be provided towards the end of the support member adjacent the respective roof portion. Providing two hinges further reduces the volume occupied by the frame members when the support members are folded.

In a further preferred embodiment the apparatus further comprises a third frame portion connectable to the first and/or second frame portion. Side panels can be attached to the third frame portion to form another enclosure which can be used a changing room for a user of the sauna.

A second aspect of the present invention provides a sauna apparatus configurable in an assembled configuration and in a disassembled configuration, wherein a recess in defined in the base of the apparatus in its assembled configuration. The recess can accommodate, for example, a footspa or other foot relaxation apparatus such as a foot massaging apparatus for use by a user of the sauna apparatus. A user is able to use the footspa or other foot relaxation apparatus while in the sauna apparatus, so adding to the beneficial effect produced by the sauna.

A recess for a footspa or other foot relaxation apparatus may be provided in a sauna apparatus according to the first aspect of the invention.

Other preferred features of the invention are set out in the dependent claims.

BRIEF DESCRIPTION OF THE FIGURES

Preferred embodiments of the present invention will now be described by way of illustrative example with reference to the accompanying drawings in which.

Like reference numerals denote like components throughout the drawings.

DETAILED DESCRIPTION OF PREFERRED EMBODIMENTS

Figure 1:
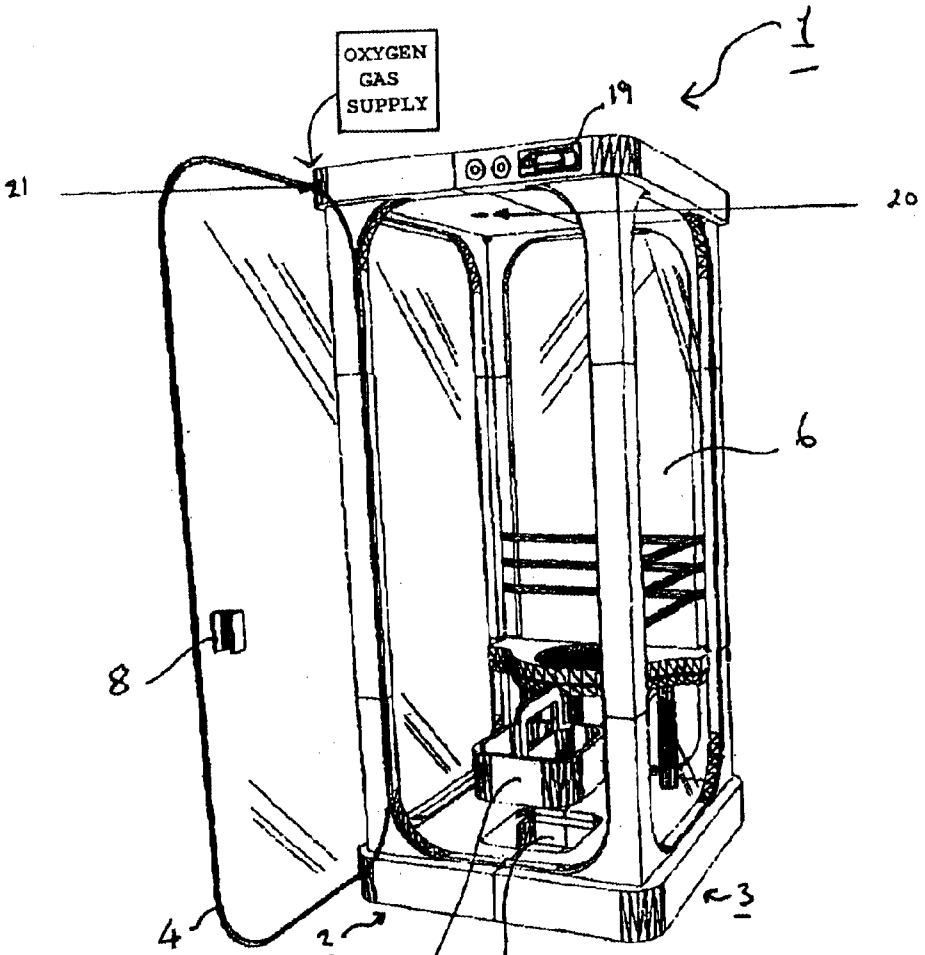
FIG. 1 is a perspective view of a sauna according to the first embodiment of the present invention in an assembled configuration.
Figure 2:
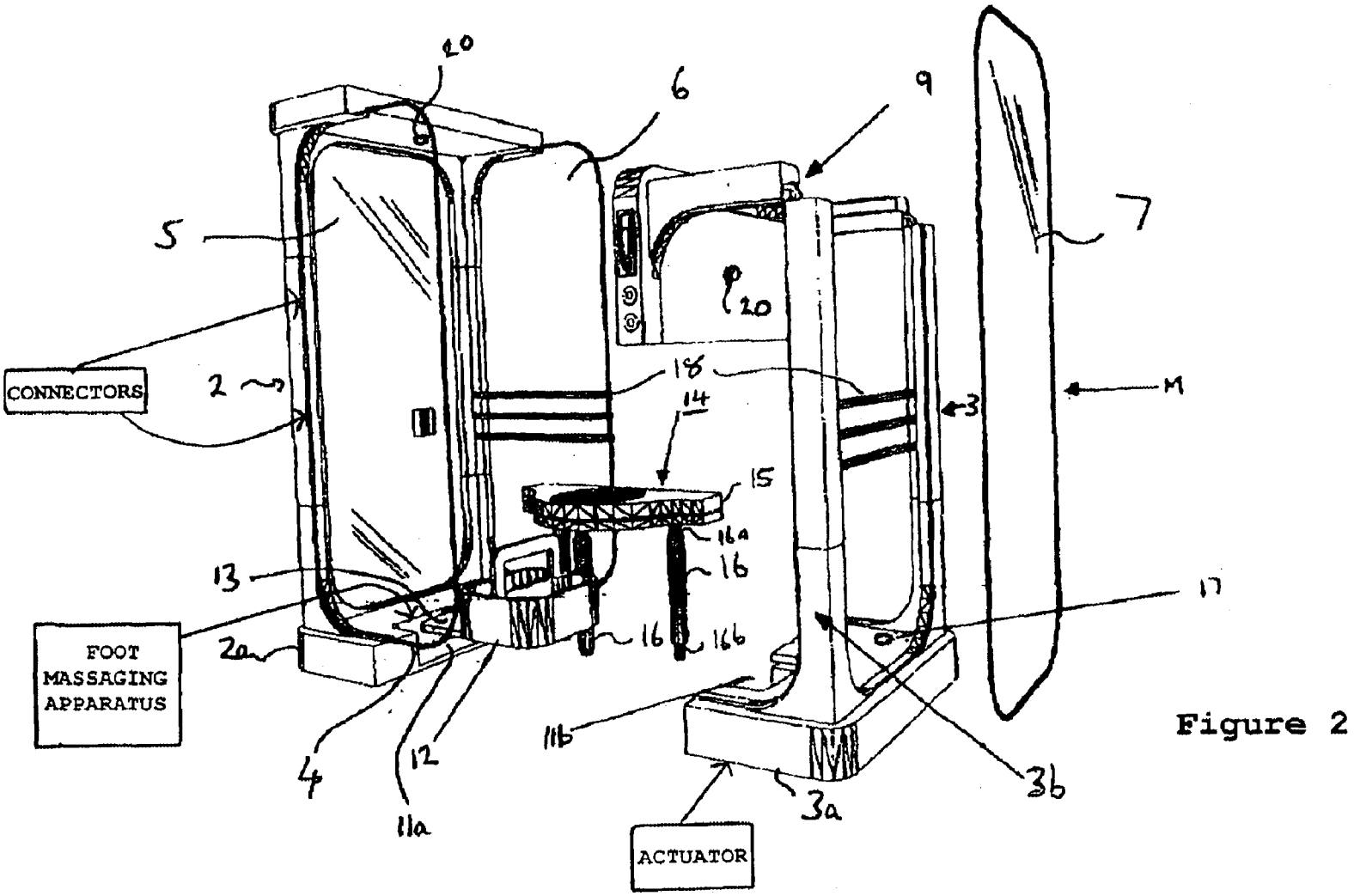
FIG. 2 is an exploded perspective view of the sauna of FIG. 1 in a partially assembled configuration.
Figure 5:
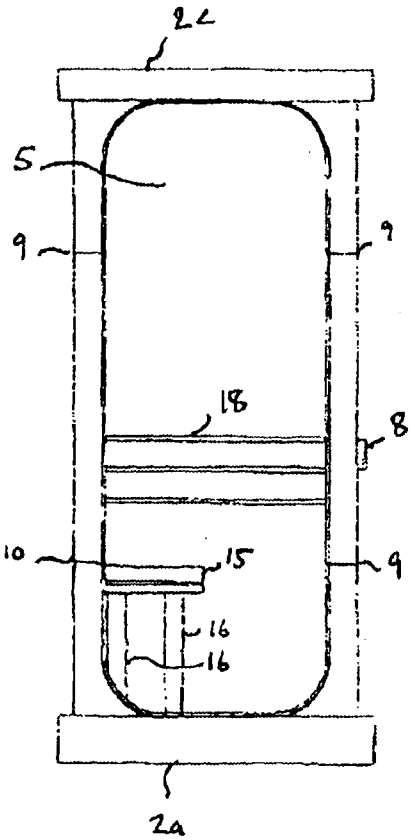
FIG. 5 is a side view of the sauna of FIG. 1.
Figure 4:
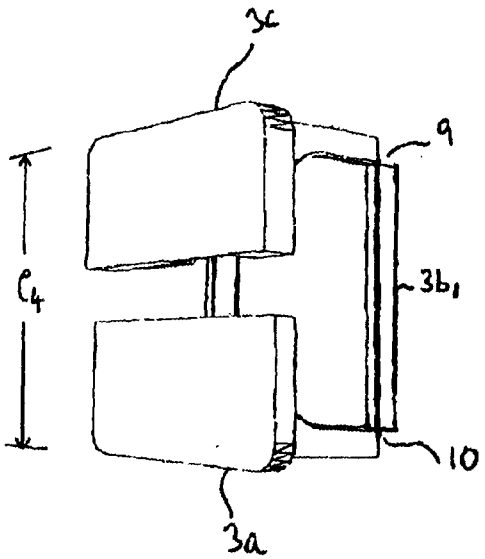
FIG. 4 is a perspective view of a frame portion of the present invention in a folded configuration.
Figure 3:
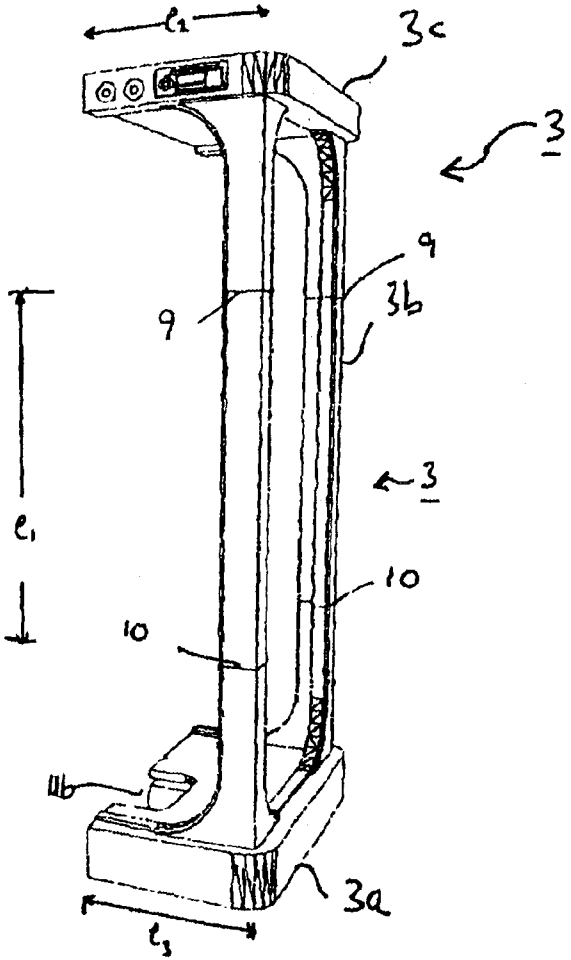
FIG. 3 is a perspective view of a frame member of a sauna of the present invention in an un-folded configuration.
Figure 6:
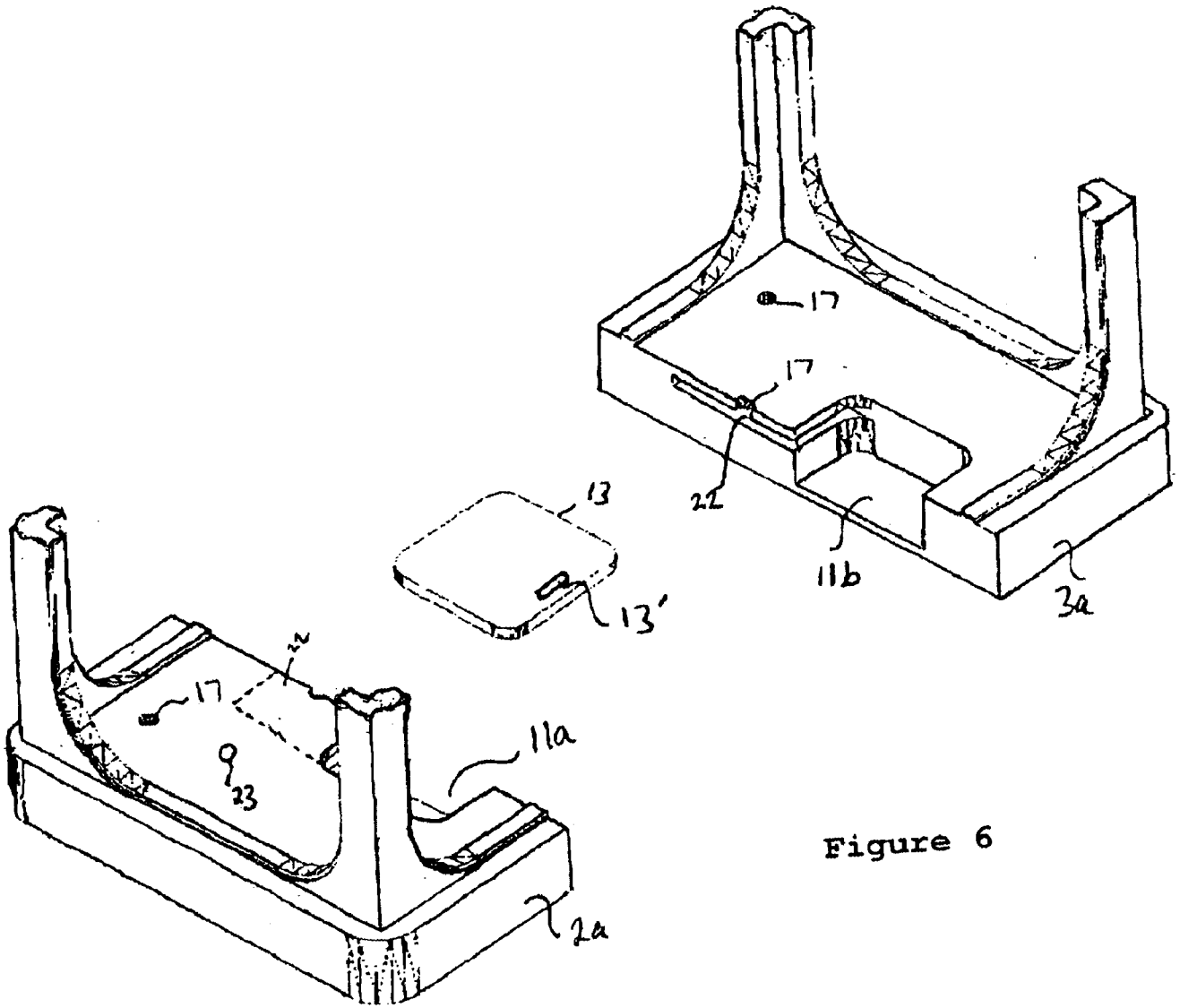
FIG. 6 is a view of the base of the sauna of FIG. 1.

FIGS. 1 to 6 show a sauna apparatus 1 according to a first embodiment of the present invention. In essence, the sauna is formed of first and second frame portions 2, 3 and four side panels 4, 5, 6, 7. FIG. 1 is a perspective view of a sauna of the invention in an assembled state, and FIG. 2 is a perspective exploded view illustrating the assembly of the sauna of FIG. 1. FIG. 5 is a view of the side elevation of the sauna of FIG. 1. FIGS. 3, 4 and 6 show components of the sauna.

Each of the frame portions 2, 3 comprises a base portion 3*a*, one or more support portions 3*b* and a roof portion 3*c*, as shown in FIG. 3. In the embodiment of FIGS. 1–5 each frame portion is provided with two support portions 2*b*,3*b*, but, in principle, only one support portion 2*b*,3*b* could be provided, or three or more support portions 2*b*,3*b*, could be provided.

In order to assemble the sauna, the first frame portion 2 is connected to the second frame portion 3. In more detail, the roof portion 2*c* of the first frame portion is connected to the roof portion 3*c* of the second frame portion, and the base portion 2*a* of the first frame portion is connected to the base portion 3*a* of the second frame portion 3. The frame portions can be connected together by any suitable connecting means (not shown in the figures). Preferably, quick-release connectors, such as clamps, buckles or coupling clips are used.

The first and second frame portions can be made of any material that has sufficient structural strength. A lightweight material is preferably used, to facilitate transporting the sauna in its disassembled state. It should be noted that different parts of the frame member carry different loads. While the base portion of the frame member must bear the weight of the support members, the side panels, the roof portion and the user of the sauna, the support members have to support only themselves, the side panels, and the roof portion. Moreover, the roof portion has to bear only its weight, and the weight of any components located in the roof (such as lights and an audio system, as described below). It is therefore possible for different parts of a frame member to be made of different materials, dependent on the load-bearing requirement of the various parts of the frame member. In one embodiment of the invention, the base portion 2*a*, 3*a* and the support members up to the upper hinge 9 are made of a stronger material than the roof portion 2*c*,3*c* and the part of each support member above the upper hinge 9. An acrylic plastics material would be suitable for the base portion 2*a*, 3*a* of the frame member and for each support member up to the upper hinge 9, whereas an ABS plastics material would be suitable for the roof portion 2*c*,3*c* of the frame member and the part of each support member above the upper hinge 9.

When the two frame portions 2, 3, are assembled, a gasket or other sealing means is preferably disposed between the roof portion 2*c* of the first frame portion and the roof portion 3*c* of the second frame portion 3. Another gasket or other sealing means is preferably disposed between the base portion 2*a* of the first frame portion and the base portion 3*a* of the second frame portion. This ensures that the roof and base of the assembled sauna are water-tight and vapour-tight.

The side panels 4, 5, 6, 7 are then assembled to the frame portions 2, 3 using suitable connectors, illustrated schematically in FIG. 2. The connectors could be, for example, clips attached to the support members 2*b*, 3*b*, of the frame portions that receive the side panels 4, 5, 6, 7. Alternatively, twist-lock connectors could be used. The side panels 4, 5, 6, 7 can be made of any material that is water and heat resistant, and that has sufficient structural strength. For example, the side panels could be made of a plastics material such as, for example lexane. One or more of the side panels may be transparent.

At least one of the side panels is preferably attached to frame portions in such a way that an opening in the enclosure can be readily formed to allow a person to enter or leave the sauna enclosure. This can be conveniently done by, for example, mounting one of the side panels 4 to one of the support members using hinges so as to form a door. The side panel mounted in this way is preferably provided with a handle 8 for ease of opening.

A gasket or other sealing means is preferably provided between each side panel and the respective frame members, to ensure that the enclosure is substantially water-tight and vapour-tight.

In order to dis-assemble the sauna of the invention, the side panels 4, 5, 6, 7 are removed from the frame portions 2, 3. The first frame portion 2 is then disconnected from the second frame portion 3. The two frame portions 2, 3 and the four side panels 4, 5, 6, 7 can then be transported and/or stored. Since the side panels and the frame members can be transported or stored separately from one another, transport and storage of a sauna of the present invention is considerably easier than transport or storage of a conventional portable sauna.

In a preferred feature of the present invention, the ease of transport or storage of a sauna of the present invention is further enhanced by the use of a hinged support members in the first and second frame portions. In the embodiment of FIGS. 1–5 each support member 2*b*, 3*b* is provided with two hinges 9, 10. One hinge is disposed towards the upper end of the support member 2*b*,3*b*, whereas the other hinge is disposed towards the lower end of the support member 2*b*,3*b*. (The terms "upper end" and "lower end" refer to the end of the support member adjacent the roof portion and the end of the support member adjacent the base portion, respectively.) Providing two hinges allows the frame members to be folded into a compact volume, as shown in FIG. 4, thereby reducing the space required to store a sauna of the present invention.

The hinges should be located such that the length $\mathbf{1}_1$ shown in FIG. 3 is slightly greater than the sum of the lengths $\mathbf{1}_2$ and $\mathbf{1}_3$ shown in FIG. 3. This enables the frame portion to fold up in the manner shown in FIG. 4, while leaving a slight gap between the base portion 3*a* and the roof portion 3*c* of the frame portion in its folded configuration. Each hinge preferably has a stop to prevent it opening by more than 90°, to avoid the risk of damage to the frame member. If the length $\mathbf{1}_1$ shown in FIG. 3 is substantially greater than the sum of the lengths $\mathbf{1}_2$ and $\mathbf{1}_3$, then the folded frame portion takes up a greater volume than necessary.

A further feature of the present invention is that a recess 11 is provided in the base of the assembled sauna. This recess can accommodate, for example, a foot spa (shown schematically as 12) or other foot relaxation equipment such as a foot massaging apparatus, for example, a vibrating plate for massaging the feet of a user of the sauna apparatus.

In the embodiment of FIGS. 1 to 6, in which the base portions 2*a*, 3*a* of the two frame portions are substantially equal in size, the recess 11 is defined by the combination of a first cut-out portion 11*a* in the first frame portion 2*b*, and by a second cut-out portion 11*a* in the second frame portion 3*b*. In principle, however, the recess 11 could be formed wholly in the base portion 2*a* of the first frame member, or wholly in the base portion 3*a* of the second frame portion 3.

The recess 11 is preferably provided with a cover 13 that can cover the recess 11 if desired, for example, if the user of the sauna does not wish to use the foot spa 12. The provision of the cover 13 will also aid entering and leaving the sauna, since closing the recess 11 with the cover 13 will make it easier for a person to enter or leave the sauna. The cover 13 is preferably made strong enough to bear the weight of a user of a user of the sauna. When the cover 13 closes the recess it is preferably flush, or nearly flush, with the upper surface of the base of the sauna, to eliminate the risk of a person tripping.

The cover 13 can be operated manually, and can be provided with a handle to allow a user of the sauna to move the cover easily. The handle preferably comprises a recess 13' in the upper surface of the cover, since this will not provide any obstruction to a user when the recess is closed by the cover.

For greater ease of use, the cover 13 is preferably provided with actuating means, such as a motor, to enable remote opening and closing of the cover 13. Thus a person can enter the sauna with the cover 13 closing the recess, and once they have settled they can operate the actuating means to move the cover and open the recess 11.

FIG. 6 is an enlarged view of the base of the sauna, showing the base portions 2*a*, 3*a*, of the two frame portions 2,3 spaced from one another. A groove 22 is provided in the base of the sauna for receiving the cover 13, so that the cover 13 can slide between a first position in which it covers the recess 11 to a second position in which the recess is partially or completely uncovered. In the embodiment of FIGS. 1 to 6 the groove 22 is formed in the base portion 2*a* of the first frame portion and in the base portion 3*a* of the second frame portion, but in principle the groove could be formed in the base portion of only one of the frame portions.

The present invention is not limited to a cover 13 that can slide between the first position and the second position. In principle the cover 13 could move between the first position and the second position other than by sliding, for example by rotating.

A bench 14 is provided inside the enclosure for a user to sit on. In the embodiment of FIGS. 1–6 the bench 14 is formed of a seat 15 that is supported by three legs 16, but other forms of bench could be used. The legs 16 are provided with reduced-diameter portions 16*a* at their upper end, and reduced-diameter portions 16*b* at their lower end. The upper reduced-diameter portions 16*a* of each leg 16 fits into a complementary recess in the underside of the seat 15, and the lower reduced-diameter portion 16*b* of each leg is received in a complementary recess 17 in the base of the sauna.

Handrails 18 are preferably provided inside the sauna, to provide assistance to the user of the sauna.

An audio system 19, such as a stereo radio and/or CD player, may be provided. In the embodiment of FIGS. 1–6 the audio system is provided in the roof of the sauna, in the roof portion of one of the frame portions. A loudspeaker (not shown) can be disposed inside the sauna enclosure if desired. Controls for the audio system 19 can be provided inside the enclosure, or alternatively they can be provided outside so that a user can preset an audio programme before they enter the sauna.

A lighting system is preferably provided in the sauna. In the embodiment of FIGS. 1–6 a low voltage lighting system having spotlights 20 is provided in the roof of the sauna, but other lighting arrangements are possible.

In a further embodiment, an aperture 21 is provided in the roof of the sauna. A supply of oxygen gas at above atmospheric pressure can be connected to the exterior of the aperture, and a flexible tube and a mask can be connected to the interior of the aperture. This enables a user of the sauna to breath air enriched with oxygen gas, or even to breath substantially pure oxygen gas, within the sauna. A switch for controlling the supply of oxygen through the aperture 21 can be provided, preferably within the sauna.

The sauna comprises means (not shown) for introducing heat, steam or aromatic vapour into the sauna enclosure. This can be done by providing internal heat and/or steam and/or vapour generating equipment in the sauna although, in principle, an external heat/steam/vapour generating means could be used. In a preferred embodiment, a steam kettle is provided within the base of the sauna to produce steam and aromatic vapour. Alternatively, or additionally, heating elements can be provided within the base to generate dry heat.

The controls for the heat/steam/vapour generating means, for the lighting (if provided), for the audio system 19 (if provided), for the supply of oxygen gas through the aperture 21 (if provided) and for the actuating means of the cover 13 (if provided), are preferably located in a single control panel for convenience of use. If a single control panel is provided, one suitable location is the interior of the roof of the sauna. The necessary electrical wiring between the control panel and the heat/steam/vapour generating means, the lighting, the audio system 19, and the actuating means of the cover are preferably disposed within the frame members 2,3. The frame members are provided with electrical connectors where wiring passes from one frame member to another.

In an embodiment of the invention in which the cover 13 is provided with an actuating means, and in which the base portion 2*a* of the first frame portion 2 is substantially the same size as the base portion 3*a* of the second frame portion 3, it is preferred that the steam/heat/vapour generating means is disposed in the base portion of one frame portion and that the actuating means for the cover is disposed in the base portion of the other frame portion. This helps to distribute weight between the two frame portions, so facilitating transport of the sauna. In principle the steam/heat/vapour generating means and the actuating means for the cover could be located in the base portion of the same frame portion, but this could mean that this frame portion would weigh significantly more than the other frame portion.

In the embodiment of FIGS. 1 to 6 the steam/heat/vapour generating means is disposed in the base portion 2*a* of the first frame portion 2 and the actuating means for the cover 13 is disposed in the base portion 3*a* of the second frame portion 3. Reference 23 in FIG. 6 denotes a vent that allows steam/heat/vapour from the steam/heat/vapour generating means to pass from the interior of the base portion 2*a* into the sauna enclosure. A further vent (not shown) is preferably provided in the upper part of the sauna.

In operation of the sauna steam or vapour may well condense on the side panels 4–7 of the sauna, or on the interior surfaces of the frame members. The base of the sauna is preferably provided with a drain (not shown), for draining water that collects as a result of such condensation. A removable drip-tray (not shown) can be located in the base of sauna below the drain, to collect water that drains through the drain. When the drip-tray is full it can be removed and emptied.

Figure 7:
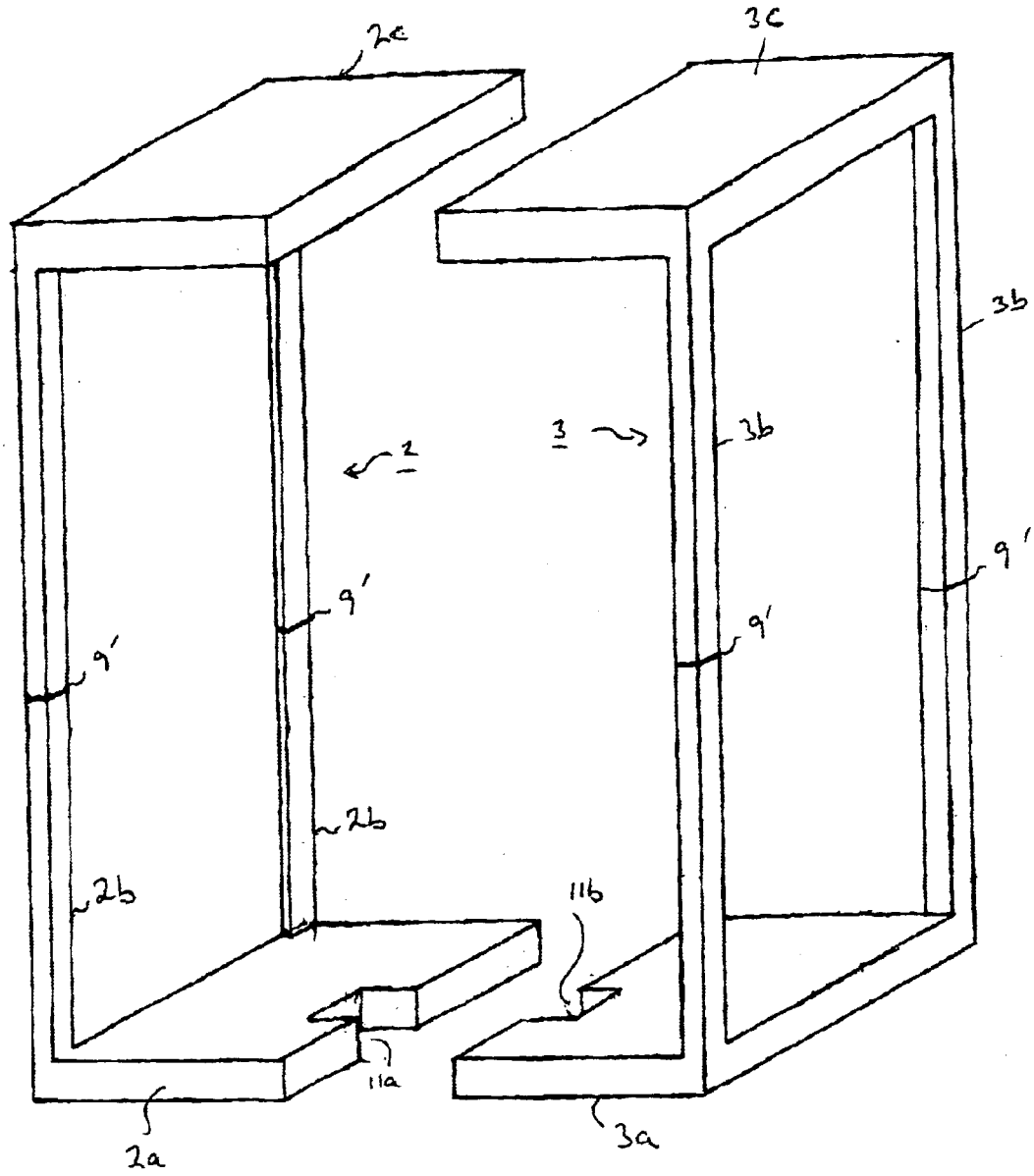
FIG. 7 is a schematic perspective view of a sauna according to a second embodiment of the present invention.

FIG. 7 is a schematic illustration of a second embodiment of the present invention. This embodiment generally corresponds to the embodiment of FIGS. 1 to 6, except that each support member of the frame portions is provided with only one hinge 9'. This hinge is provided substantially at the mid-point of the support members 2*b*, 3*b* of each of the frame portions. Other features of the sauna of this embodiment are the same as those of the sauna of FIGS. 1 to 6, and the description of these features will not be repeated.

A further embodiment of the present invention provides a sauna having a changing room for a user of the sauna. A sauna according to either of the embodiments described above can be provided with a changing room.

Figure 8:
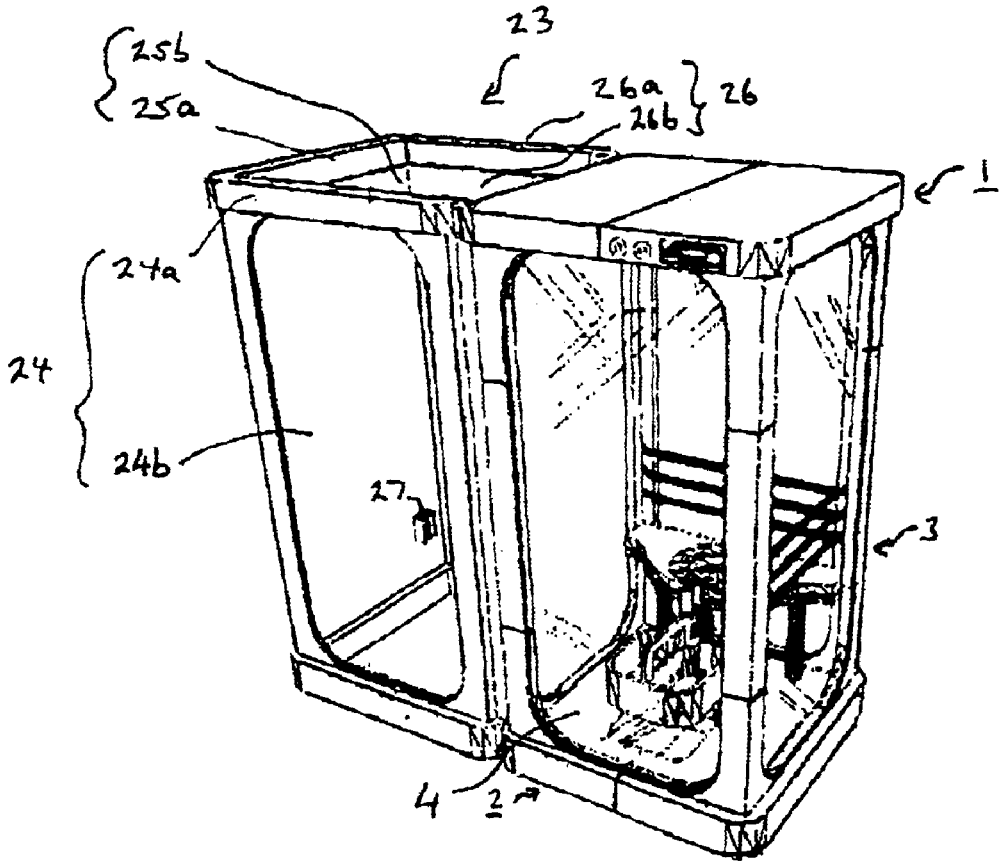
FIG. 8 is a schematic perspective view of a sauna according to a third embodiment of the present invention.
Figure 9:
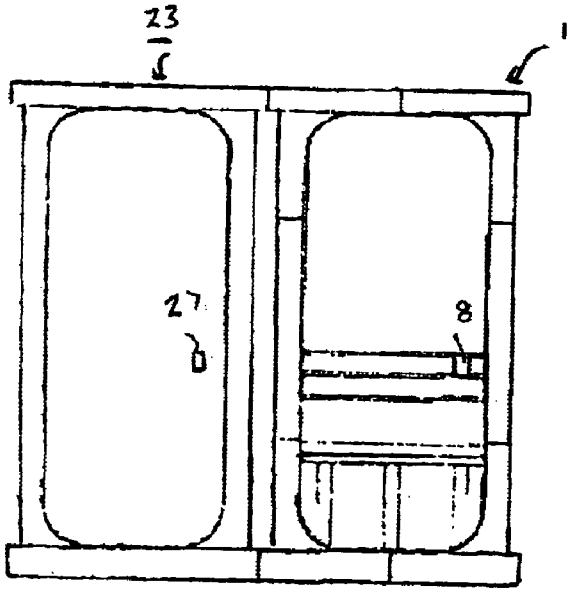
FIG. 9 is a side view of the sauna of FIG. 8.

FIGS. 8 and 9 illustrate an embodiment of the invention in which a sauna 1 is provided with a changing room 23. The sauna 1 shown in FIGS. 8 and 9 is identical to the sauna described with reference to FIGS. 1 to 6 above, and the description of the sauna will not be repeated here.

The changing room 23 is formed from three side members 24, 25, 26. In the embodiment of FIGS. 8 and 9 each side member 24,25,26 is formed of a frame member 24*a*,25*a*,26*a* and a panel 24*b*,25*b*,26*b* received in the frame. At least one of the panels is preferably attached to the corresponding frame member in such a way that an opening can be formed to allow a person to enter or leave changing room 23. In the embodiment of FIGS. 8 and 9 one of the panels 24*b* is hingedly mounted in its corresponding frame member 24*a*, to form a door into the changing room. A handle 27 is provided on the panel 24*b*. The frame members 24*a*,25*a*,26*a* and the panels 24*b*,25*b*,26*b* are preferably formed from strong, lightweight materials, such as a plastics material. The frame members and the panels are preferably opaque or translucent to provide privacy. The opening panel 24*b* can be provided with an internal lock, again to provide privacy.

The changing room 23 is assembled by connecting one end of one frame member 24*a* to the sauna 1 at or near one corner of the sauna, and connecting one end of another frame member 26*a* to the sauna 1 at or near an adjacent corner of the sauna. The two frame members 24*a*,26*a* can be connected to the sauna 1 using any conventional connector such as a clamp. The remaining frame member 25*a* is then connected to these frame members 24*a*,26*a*, again using any conventional connector.

To disassemble the changing room, the assembly process is reversed. The three side members 24,25,26 can then be stacked for storage or transport.

If desired, the panels 24*b*,25*b*,26*b* can be releasably fastened to the corresponding frame member. This allows the panels to be removed from the frame members when the changing room is disassembled.

The changing room is not provided with a heat, steam, or vapour generating unit, and so will be at substantially room temperature (although warmed to some extent by conduction of heat from the sauna). The changing room 23 shown in FIGS. 8 and 9 is not provided with a roof, and is simply open at the top. The changing room 23 shown in FIGS. 8 and 9 is also not provided with floor, and the floor of the building in which the changing room is located will form the floor of the changing room. In principle, however, the changing room could be provided with a separate roof and/or floor.

In use, a user can enter the changing room, change there, and then leave the changing room. They then open the side panel 4 of the sauna 1 and go into the sauna 1. Once they have finished in the sauna, they can then leave the sauna 1 and return to the changing room.

The interior of the changing room can be provided with items such as a mirror, clothes hooks, a locker for clothes and personal items, a hairdryer etc.

A sauna of the present invention can be used at home, or it can be used in commercial applications such as at a sports club. Where the sauna is intended for a commercial use, it can be provided with a meter such as for example, a coin-operated, token-operated or magnetic-card-operated meter so that the owner or operator of the sauna can readily collect payment from users of the sauna. The meter may, for example, be interlocked with the heat, steam or vapour generating apparatus of the sauna, so that no heat, steam or vapour is generated until a user has inserted a coin, token or card into the meter. Once a user has inserted a coin, token or card into the meter, the sauna will operate for a predetermined period. Alternatively, the door of the sauna may be provided with a lock that is interlocked with the meter, so that the door is unlocked when a user inserts a coin, token or card into the meter.

The embodiments of the invention described above relate specifically to a sauna apparatus in which the frame is formed from two frame portions. The invention is not, however, limited to a sauna formed from two frame portions and, in principle, the sauna could be formed from three or more frame portions.

Moreover, the recess for accommodating a footspa or other foot relaxation apparatus is not restricted to use in a sauna apparatus having a frame is formed from two or more frame portions. In principle, a recess for accommodating a footspa or other foot relaxation apparatus could be incorporated in a sauna of any conventional design.

In the embodiments described above the support members 2*b*,3*b* of the frame portions 2,3 are provided with at least one hinge to allow the frame portions to be folded to reduce the space required to store the sauna when it has been disassembled. In an alternative embodiment of the invention the support members 2*b*,3*b* of the frame portions are not provided with hinges, but are telescopic. This enables the length of a support member can be reduced when the sauna has been disassembled, so that the space required to store the sauna is reduced.

A support can be made telescopic by, for example, providing the parts of the support member attached to the base and roof portions with a hollow cross-section, with internal dimensions greater than the external dimensions of the central part of the support member. Alternatively the central part of the support member can be provided with a hollow cross-section, with internal dimensions greater than the external dimensions of the parts of the support member attached to the base and roof portions.

In principle, one of the frame portions could be provided with hinged support members and the other frame portion could be provided with telescopic support members.

In a further embodiment of the invention, the support member are provided with hinges 9,10, and are also provided with one or more telescopic sections. For example the central part $\mathbf{3}b_1$ of the support member located between the upper hinge 9 and the lower hinge 10 could be made telescopic. When the sauna was disassembled, the support member would initially be folded to give the configuration shown in FIG. 4. If the central section $\mathbf{3}b_1$ is telescopic, the length $\mathbf{1}_4$ shown in FIG. 4 could then be reduced to the minimum possible. This would reduce the space required for storage of the disassembled sauna. Moreover, if the length of the central part of the support member were reduced so that the roof portion 3*c* of the frame portion abutted against the base portion 3*a*, then the risk of damage to the frame portion during transport and storage would be reduced.

What is claimed is:

1. A portable sauna, comprising:

first and second frame portions, each of the frame portions comprising:

a base portion;

a roof portion; and at least one folding support member non-hingedly secured to and extending away from the base portion at a first end, and non-hingedly secured to and extending away from the roof portion at a second end, each said at least one support member comprising at least one hinge arranged away from both the roof portion and the base portion, and positioned to allow the base portion and the roof portion to fold toward one another;

means for connecting together the first and second frame portions; and a plurality of side panels, each releasably connected to at least one of the first and second frame portions.

2. The apparatus as claimed in claim 1 wherein each of the first and second frame portions comprises two said support members connecting the base portion to the roof portion, the support members being spaced apart from one another.

3. The apparatus as claimed in claim 1 wherein each said at least one support member is provided with a first hinge and with a second hinge.

4. The apparatus as claimed in claim 3 wherein the first hinge is provided towards the first end of the support member, and the second hinge is provided towards the second end of the support member.

5. The apparatus as claimed in claim 1 wherein each frame portion is provided with connectors for receiving at least one side panel.

6. The apparatus as claimed in claim 5 wherein the connectors are provided on the support members.

7. The apparatus as claimed in claim 6 wherein at least one of the support members is provided with hinged connectors for hingedly receiving the at least one side panel.

8. The apparatus as claimed in claim 1 wherein a recess is defined in the base of the apparatus in the assembled configuration.

9. The apparatus as claimed in claim 8 wherein the recess in the base of the apparatus in the assembled configuration is formed by a first recess in the base portion of the first frame portion co-operating with a second recess in the base portion of the second frame portion.

10. The apparatus as claimed in claim 9 and further comprising a footspa receivable in the recess in the base of the sauna.

11. The apparatus as claimed in claim 9 and further comprising a foot massaging apparatus receivable in the recess in the base of the sauna.

12. The apparatus as claimed in claim 9 and further comprising a removable cover for the recess.

13. The apparatus as claimed in claim 12 and further comprising an actuator arranged to move the cover between a first position in which it closes the recess and a second position.

14. The apparatus as claimed in claim 13 wherein the actuator is disposed within the base portion of one of the frame portions.

15. The apparatus as claimed in claim 1 and further comprising an oxygen gas supply.

16. An apparatus as claimed in claim 1 and further comprising a changing room for a user, the changing room being configurable in an assembled configuration and in a disassembled configuration and comprising first and second side members connectable to the sauna apparatus and a third side member connectable to the first and second side members.

* * * * *